US006860127B2

(12) United States Patent
Chen

(10) Patent No.: US 6,860,127 B2
(45) Date of Patent: Mar. 1, 2005

(54) WEATHER-RESISTANT LOCK APPARATUS

(75) Inventor: Waterson Chen, Taichung (TW)

(73) Assignee: Waterson Corporation, Taichung (TW)

( * ) Notice: Subject to any disclaimer, the term of this patent is extended or adjusted under 35 U.S.C. 154(b) by 40 days.

(21) Appl. No.: 10/608,611

(22) Filed: Jun. 27, 2003

(65) Prior Publication Data

US 2004/0194516 A1 Oct. 7, 2004

(30) Foreign Application Priority Data

Apr. 3, 2003 (TW) ..... 92107643 A

(51) Int. Cl.[7] ..... E05B 67/28
(52) U.S. Cl. ..... 70/38 A; 70/365; 70/377
(58) Field of Search ..... 70/38 A, 365, 70/366, 377

(56) References Cited

U.S. PATENT DOCUMENTS 4,067,214 A * 1/1978 Kiraly ..... 70/366
4,359,886 A * 11/1982 Evans et al. ..... 70/366
4,644,768 A * 2/1987 Nowak et al. ..... 70/492
5,490,405 A * 2/1996 Ramo et al. ..... 70/366
5,544,509 A * 8/1996 Mielonen ..... 70/366
5,592,837 A * 1/1997 McBride ..... 70/38 A
5,931,030 A * 8/1999 Chen ..... 70/38 A
5,934,121 A * 8/1999 Chen ..... 70/365
6,185,966 B1 * 2/2001 Chen ..... 70/366
6,553,801 B2 * 4/2003 Chen ..... 70/366

* cited by examiner

*Primary Examiner*—John B. Walsh
(74) *Attorney, Agent, or Firm*—Ohlandt, Greeley, Ruggiero & Perle, LLP

(57) ABSTRACT

A lock core unit of a weather-resistant lock apparatus includes an inner shell received in and rotatable relative to a lock shell, a plurality of locking plates received in and rotatable relative to the inner shell and cooperating to form a keyhole of the lock core unit, a locking unit operably associated with the locking plates for locking the inner shell against rotation relative to the lock shell in a locking state of the locking plates, and for unlocking the inner shell for rotation relative to the lock shell in an unlocking state of the locking plates, a latch actuator coupled to the inner shell, and a plurality of spacer plates, each of which is disposed between an adjacent pair of the locking plates. The spacer plates are made of a material with a hardness less than that of the locking plates.

23 Claims, 13 Drawing Sheets

WEATHER-RESISTANT LOCK APPARATUS

CROSS-REFERENCE TO RELATED APPLICATION

This application claims priority of Taiwan Patent Application No. 092107643, filed on Apr. 3, 2003.

BACKGROUND OF THE INVENTION

1. Field of the Invention

The invention relates to a lock apparatus, more particularly to a weather-resistant lock apparatus that is suitable for use in dusty and wet environments.

2. Description of the Related Art

In current padlock structures, a padlock body includes a padlock housing and a U-shaped shackle, and a lock core device is mounted in the padlock housing. The lock core device is operable to engage and disengage the shackle so as to enable locking and unlocking operations in a conventional manner. However, in a conventional padlock, as clearances or gaps are present between the padlock housing and the shackle after assembly, and as the lock core device is provided with a keyhole for receiving a key, if the padlock is used outdoors and is exposed to influences of natural forces, such as rain and wind, the service life of the padlock will be shortened. For instance, if the padlock is used in a windy and sandy environment, tiny grains of sand and grit may gain entry into the interior of the lock core device through the keyhole and cause jamming of the internal components of the lock core device, thereby rendering the padlock inoperable. Moreover, if the padlock is used in a wet and humid environment, moisture may seep into the interior of the padlock housing through available clearances and gaps so that, after a period of time, components within the padlock housing will become rusty. Furthermore, if the padlock is used in cold climates, any moisture that gets into the interior of the padlock may lead to freezing of the internal components, thereby rendering the padlock inoperable. Although the padlock may be provided with a protective shroud to help maintain the operability of the padlock in harsh and extreme environments, in order to meet government regulations, such as those set by the U.S. Department of Defense, padlocks should not have an external protective shroud and should be resistant to dirt, moisture, corrosion, freezing, etc., by virtue of their inherent construction. Therefore, as to how padlocks can be constructed to endure extreme environments without having a protective shroud is the object of endeavor of manufacturers in the industry.

SUMMARY OF THE INVENTION

Therefore, the object of the present invention is to provide a weather-resistant lock apparatus suitable for use in dusty and wet environments.

According to the present invention, a weather-resistant lock apparatus comprises a lock core device that includes a lock shell and a lock core unit. The lock core unit includes an inner shell received in and rotatable relative to the lock shell, a plurality of locking plates received in and rotatable relative to the inner shell and cooperating to form a keyhole of the lock core unit, a locking unit operably associated with the locking plates for locking the inner shell against rotation relative to the lock shell in a locking state of the locking plates, and for unlocking the inner shell for rotation relative to the lock shell in an unlocking state of the locking plates, a latch actuator coupled to the inner shell, and a plurality of spacer plates, each of which is disposed between an adjacent pair of the locking plates. The spacer plates are made of a material with a hardness less than that of the locking plates.

Preferably, the lock core unit further includes a drive plate received in and rotatable relative to the inner shell. The drive plate is disposed between the locking plates and the latch actuator, and cooperates with the locking plates to form the keyhole. The drive plate is capable of transmitting a rotary force applied through a correct key that was inserted into the keyhole to the latch actuator.

Preferably, the drive plate is formed with a non-circular drive hole that forms a part of the keyhole. The lock core unit further includes a rotation control member mounted on the latch actuator and registered with the drive hole. The rotation control member extends into and engages the drive plate in the drive hole to prohibit rotation of the drive plate, and is movable to disengage from the drive plate when the correct key is inserted into the keyhole so as to permit rotation of the drive plate with the correct key in order to drive rotation of the latch actuator.

Preferably, the lock apparatus further comprises a padlock body that includes a padlock housing and a shackle member. The padlock housing is formed with a core chamber, and has a bottom portion formed with an opening for access into the core chamber. The lock core device is received in the core chamber. The padlock housing further has a top portion formed with two shackle holes. The shackle member has two insert ends that are inserted into the shackle holes, respectively.

Preferably, the padlock body further includes a latch unit disposed in the padlock housing and coupled to the latch actuator for engaging at least one of the insert ends of the shackle member.

Preferably, the padlock body further includes two seal rings, each of which is retained in a respective one of the shackle holes for establishing airtight contact with a respective one of the insert ends of the shackle member.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
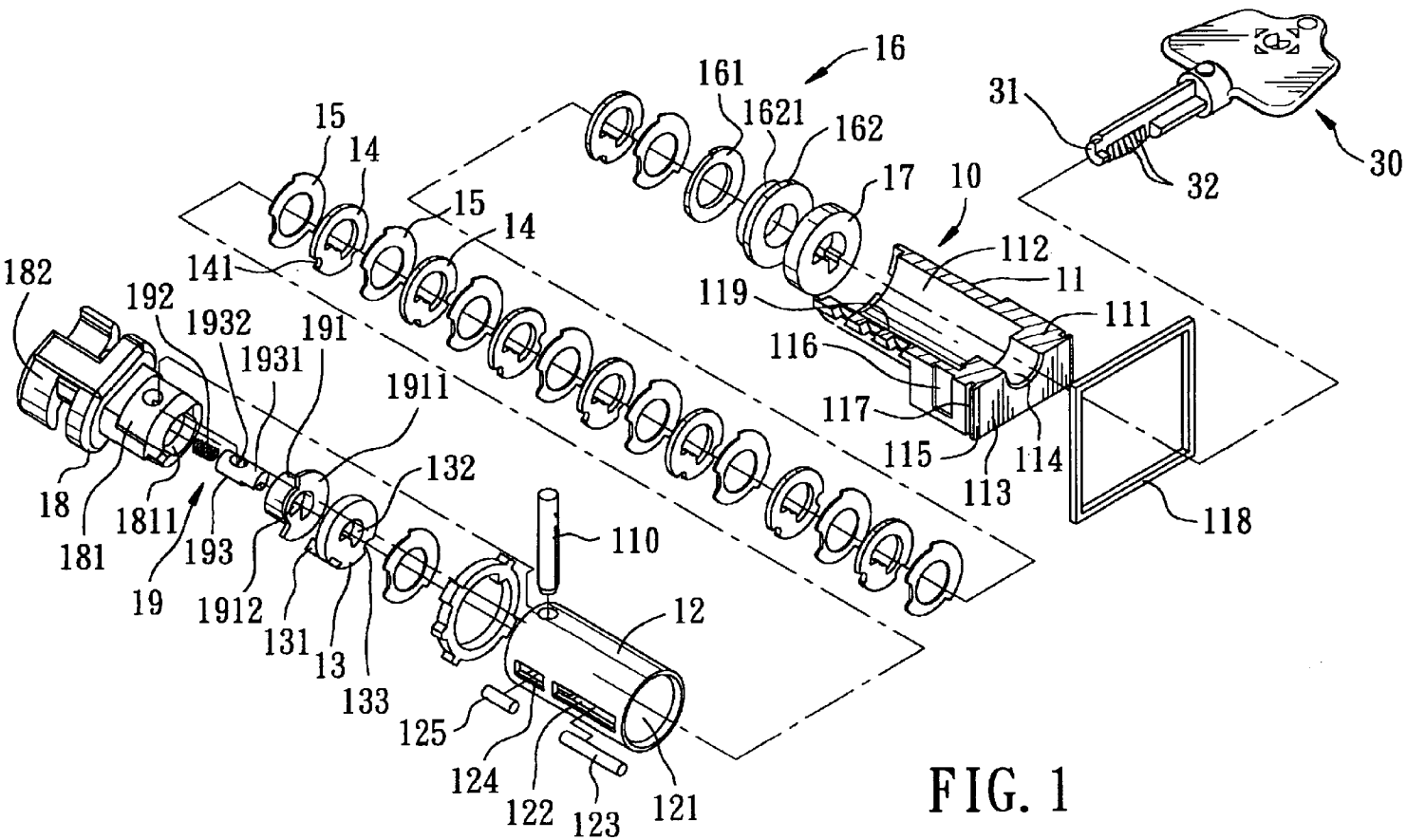
FIG. 1 is an exploded perspective view showing a lock core device and a key of the first preferred embodiment of a weather-resistant lock apparatus according to this invention.

Before the present invention is described in greater detail, it should be noted that like elements are denoted by the same reference numerals throughout the disclosure.

Referring to FIGS. 1 to 4, the weather-resistant lock apparatus according to the present invention is shown to be embodied in a padlock that includes a lock core device 10, a padlock body 20 (see FIGS. 3 and 4), and a key 30 that can work on the lock core device 10 for locking and unlocking purposes. The key 30 has an actuating tip portion 31 at a foremost end, and a plurality of key bit portions 32 that are provided on a shank portion of the key 30 and that form different predetermined angles with the shank portion.

Figure 2:
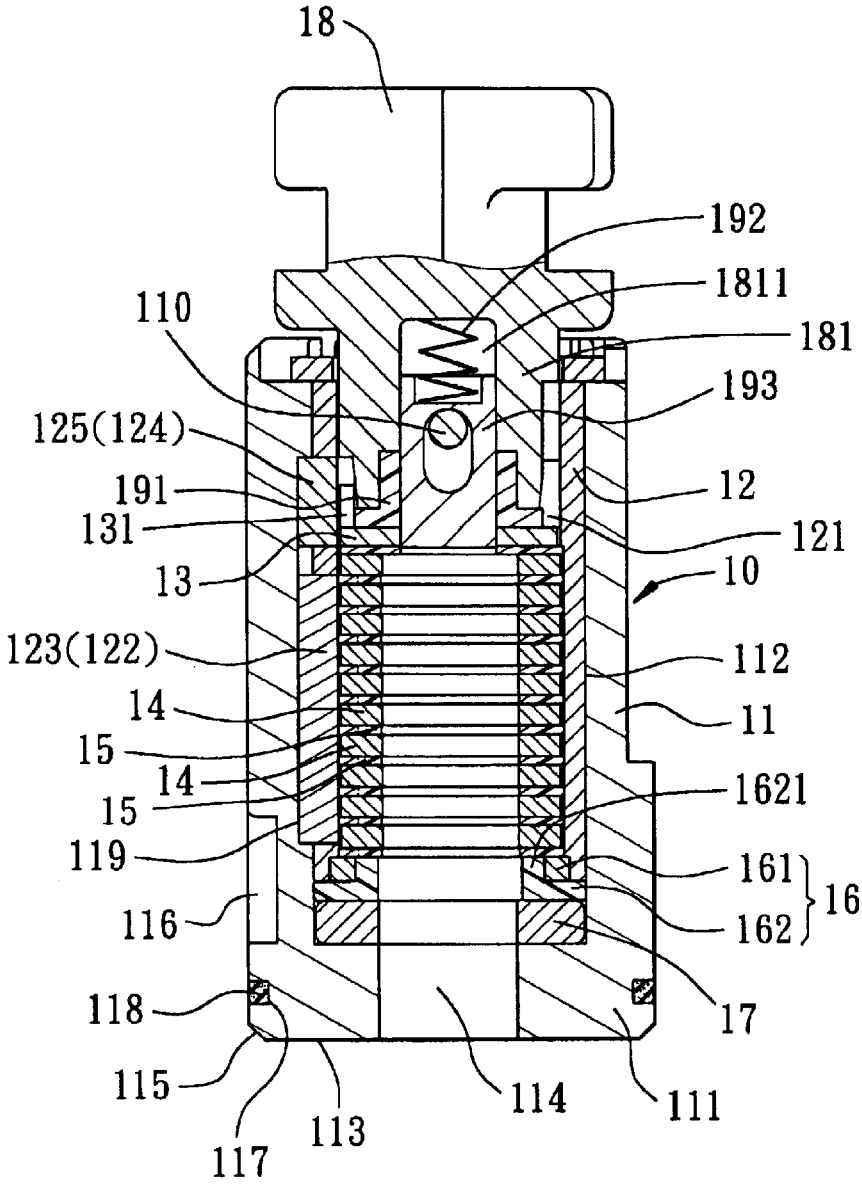
FIG. 2 is an assembled sectional view of the lock core device of FIG. 1.

The lock core device 10 is of the type disclosed in, for example, U.S. Pat. Nos. 5,934,121 and 6,185,966, the entire disclosures of which are incorporated herein by reference. As shown in FIGS. 1 and 2, the lock core device 10 includes a lock shell 11 and a lock core unit. The lock core unit includes an inner shell 12, a drive plate 13, a plurality of locking plates 14, a plurality of annular spacer plates 15, a sealing member 16, a protective plate 17, a latch actuator 18, and a rotation control member 191.

The lock shell 11 has a substantially rectangular head end 111 and a hollow interior confining a receiving chamber 112. The head end 111 has a square end face 113, and is formed with a key access hole 114 extending through the end face 113 and communicated with the receiving chamber 112. The end face 113 is formed with a beveled periphery 115. An insert groove 116 is formed in a lateral side of the head end 111. A retaining groove 117 is formed in a peripheral surface of the head end 111 for receiving a seal member 118 fittingly therein. In this embodiment, the seal member 118 is shaped as a rectangular loop. Since the seal member 118 and the beveled periphery 115 are configured to conform to the contour or shape of the head end 111, if the head end 111 is circular in shape, the seal member 118 and the beveled periphery 115 will be circular accordingly.

The inner shell 12 is received in the receiving chamber 112, is rotatable relative to the lock shell 11, and has a hollow interior confining an axial hole 121 for receiving, in sequence, the drive plate 13, the locking plates 14, the spacer plates 15, and the sealing member 16. The inner shell 12 has a tubular wall that is formed with a first slot 122 corresponding in position to the locking plates 14 for receiving a first locking unit in the form of a first control rod 123, and a second slot 124 corresponding in position to the drive plate 13 for receiving a second locking unit in the form of a second control rod 125. The first and second control rods 123, 125 are operably and respectively associated with the locking plates 14 and the drive plate 15 so as to be retained between the inner shell 12 and a longitudinal groove 119 formed in an inner surface of the lock shell 11, whereby rotation of the inner shell 12 relative to the lock shell 11 can be prevented. The drive plate 13 has an outer periphery provided with a drive projection 131 and a notch 133, and is further formed with a non-circular drive hole 132 in the center thereof. In this embodiment, the drive hole 132 is in the shape of three-quarters of a circle, and is disposed to receive the actuating tip portion 31 of the key 30. It is noted that only when the actuating tip portion 31 of the key 30 matches the shape of the drive hole 132 will the key 30 be able to drive rotation of the drive plate 13. The drive hole 132 thus forms a part of a keyhole of the lock core device 10, and the drive plate 13 thus serves as a code-setting unit of the lock core device 10. Certainly, the drive hole 132 can be configured to have any other shape. The locking plates 14 are circular plates made of stainless steel. Each of the locking plates 14 has an outer periphery formed with a notch 141 at a predetermined position. Holes formed through the locking plates 14 correspond to the key bit portions 32 of the key 30, and cooperate to form another part of the keyhole of the lock core device 10 such that the locking plates 14 generally serve as another code-setting unit of the lock core device 10. The locking plates 14 and the spacer plates 15 are arranged in a stack within the axial hole 121. Each of the spacer plates 15 is disposed between an adjacent pair of the locking plates 14, and serves to maintain smooth rotation of the locking plates 14. Most importantly, the spacer plates 15 in this invention are made of tetrafluoroethylene polymer, which has a hardness less than that of the locking plates 14 made of stainless steel, and which is capable of trapping granules pressed thereinto. Moreover, as tetrafluoroethylene polymer is known to exhibit lubricating characteristics, it can serve as a substitute for conventional lubricants. It is noted that the conventional lock core device is often stained with dirt during lubrication, thereby dirtying the key 30 and obstructing turning of the key 30. With the use of the tetrafluoroethylene polymer spacer plates 15 in this invention, there is no need for additional lubrication, thus eliminating the aforesaid problem. The sealing member 16 is disposed at a foremost end of the inner shell 12, i.e., adjacent to the key access hole 114, and includes a sealing ring 161 and a protective sleeve 162. The sealing ring 161 is press-fitted within the axial hole 121 in the inner shell 12. The protective sleeve 162 is also made of tetrafluoroethylene polymer, and is press-fitted in the receiving chamber 112 of the lock shell 11. The protective sleeve 162 is formed with an annular skirt 1621, which extends into and which is in sleeved engagement with the sealing ring 161. Accordingly, the sealing member 16 can effectively block entry of dust, sand and water into the interior of the lock core device 10. The protective plate 17 is fitted between the inner shell 12 and the head end 111 of the lock shell 11, and is in contact with the protective sleeve 162. The protective plate 17 is made from a high-strength metal alloy, and is capable of idle rotation within the receiving chamber 112 so as to withstand a drilling action coming from a direction of the key access hole 114, thereby avoiding destruction of the lock core device 10 due to the drilling action.

The latch actuator 18 has a coupling portion 181 and an actuating portion 182. The coupling portion 181 is fitted into the axial hole 121 in a rear end of the inner shell 12. A retaining pin 110 is extended through the inner shell 12 to secure the coupling portion 181 in place. The coupling portion 181 is formed with a cavity 1811 for receiving the rotation control member 19 therein. The sleeve member 191, which is also made of tetrafluoroethylene polymer, is mounted fittingly in the cavity 1811. The sleeve member 191 has a fan-shaped end wall 1911. The drive projection 131 of the drive plate 13 engages the end wall 1911 so as to transmit rotation of the drive plate 13 to the latch actuator 18. The end wall 1911 is formed with a shaped hole 1912 therethrough. Like the drive hole 132 in the drive plate 13, the shaped hole 1912 is also in the shape of three-quarters of a circle.

The rotation control member 19 includes a spring 192 and a control pin 193 that are disposed in the cavity 1811. The control pin 193 is biased by the spring 192 toward the drive plate 13. The control pin 193 has a front end that serves as a stop end 1931, which has a cross section identical to the shape of the drive hole 132 and the shaped hole 1912. The control pin 193 is further formed with an axially extending slot 1932 therealong. The retaining pin 110 further extends through the slot 1932 to limit axial movement of the control pin 193.

In this embodiment, the lock core device 10 is formed as a detachable module that can be mounted in the padlock body 20. However, it should be appreciated by those skilled in the art that the lock core device 10 can be also used in a wide range of other applications, such as in door locks, auxiliary locks, and other lock apparatuses.

Figure 3:
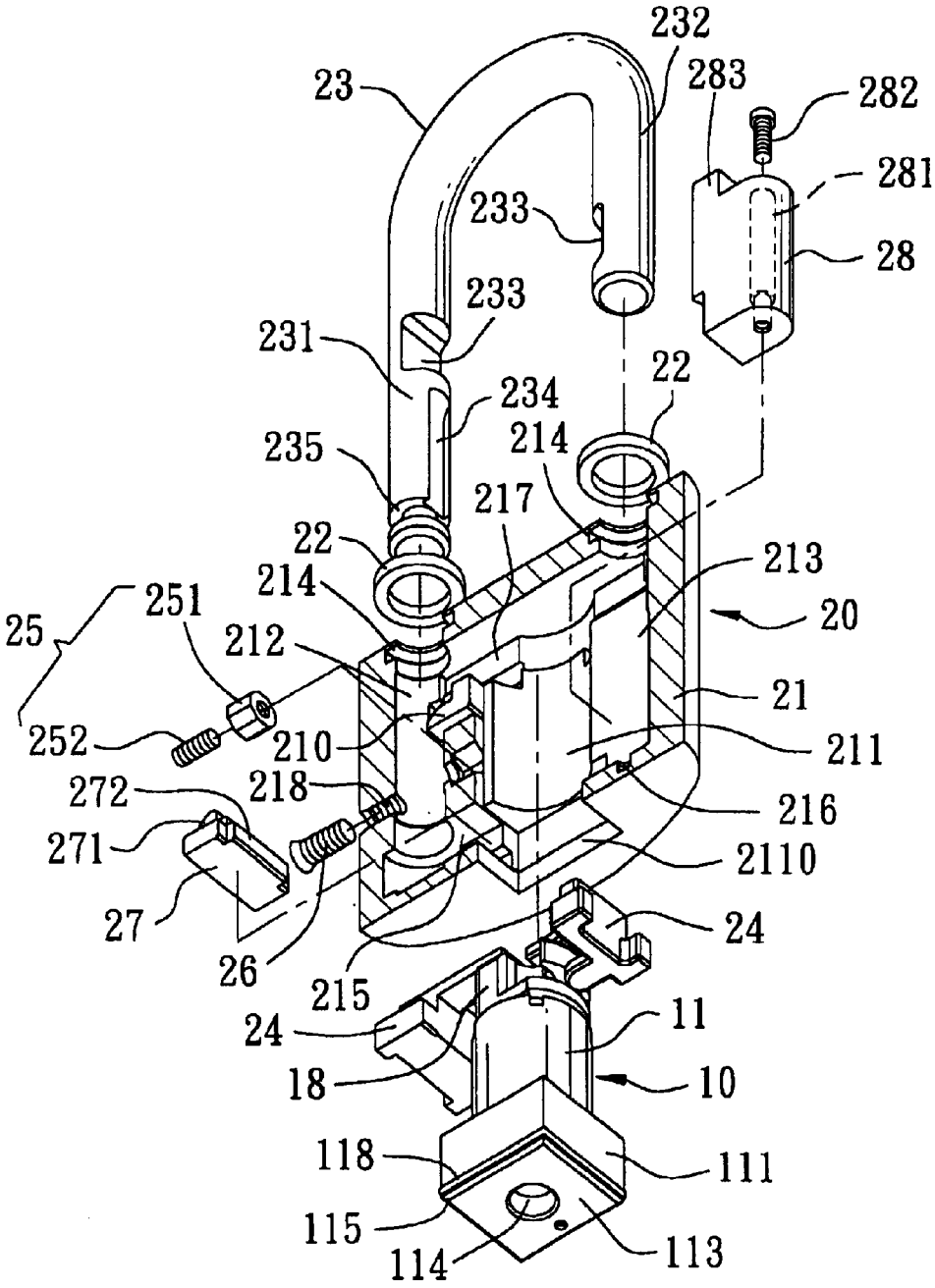
FIG. 3 is a partly sectioned, exploded perspective view of the first preferred embodiment to illustrate a padlock body in an exploded state.
Figure 4:
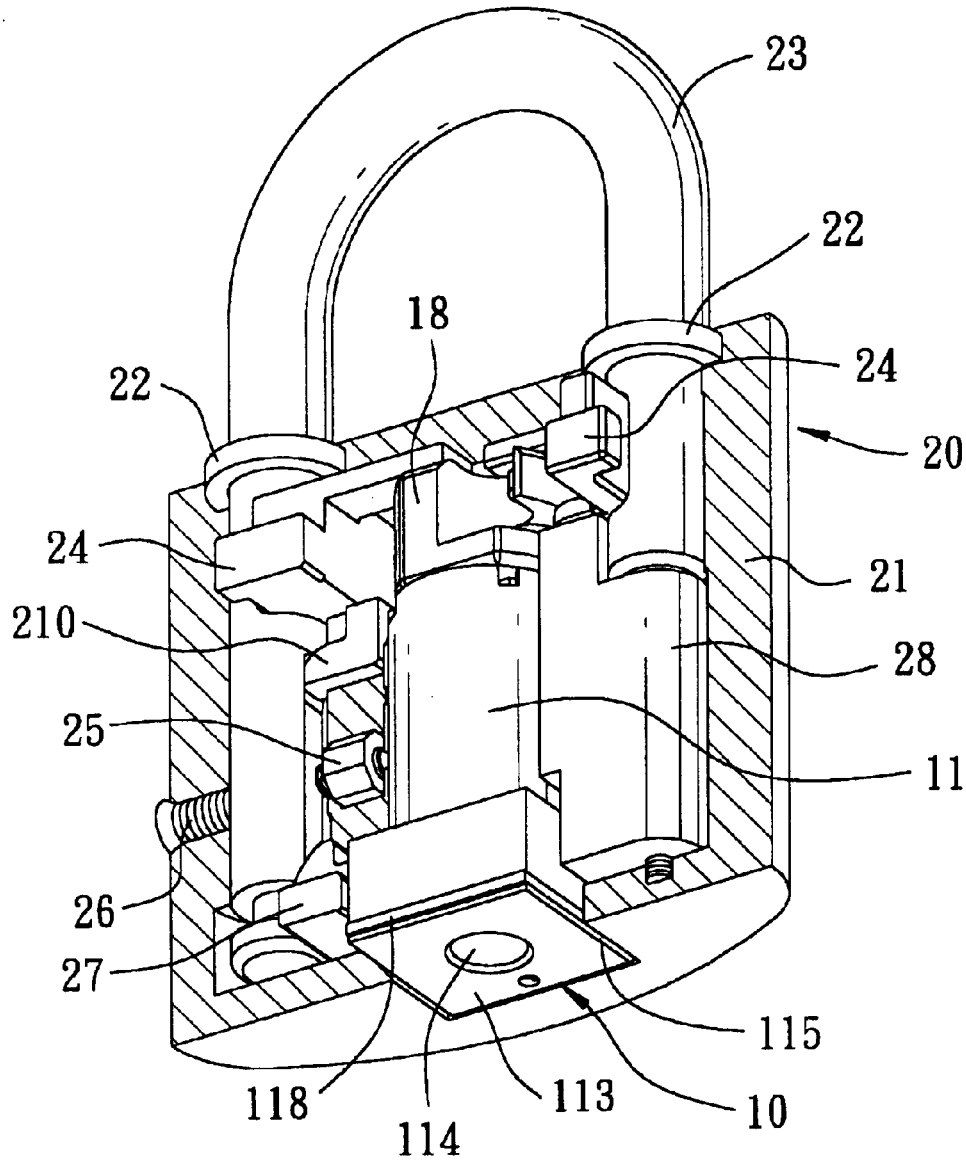
FIG. 4 is a partly sectioned perspective view of the first preferred embodiment, illustrating the lock core device when assembled to the padlock body.
Figure 5:
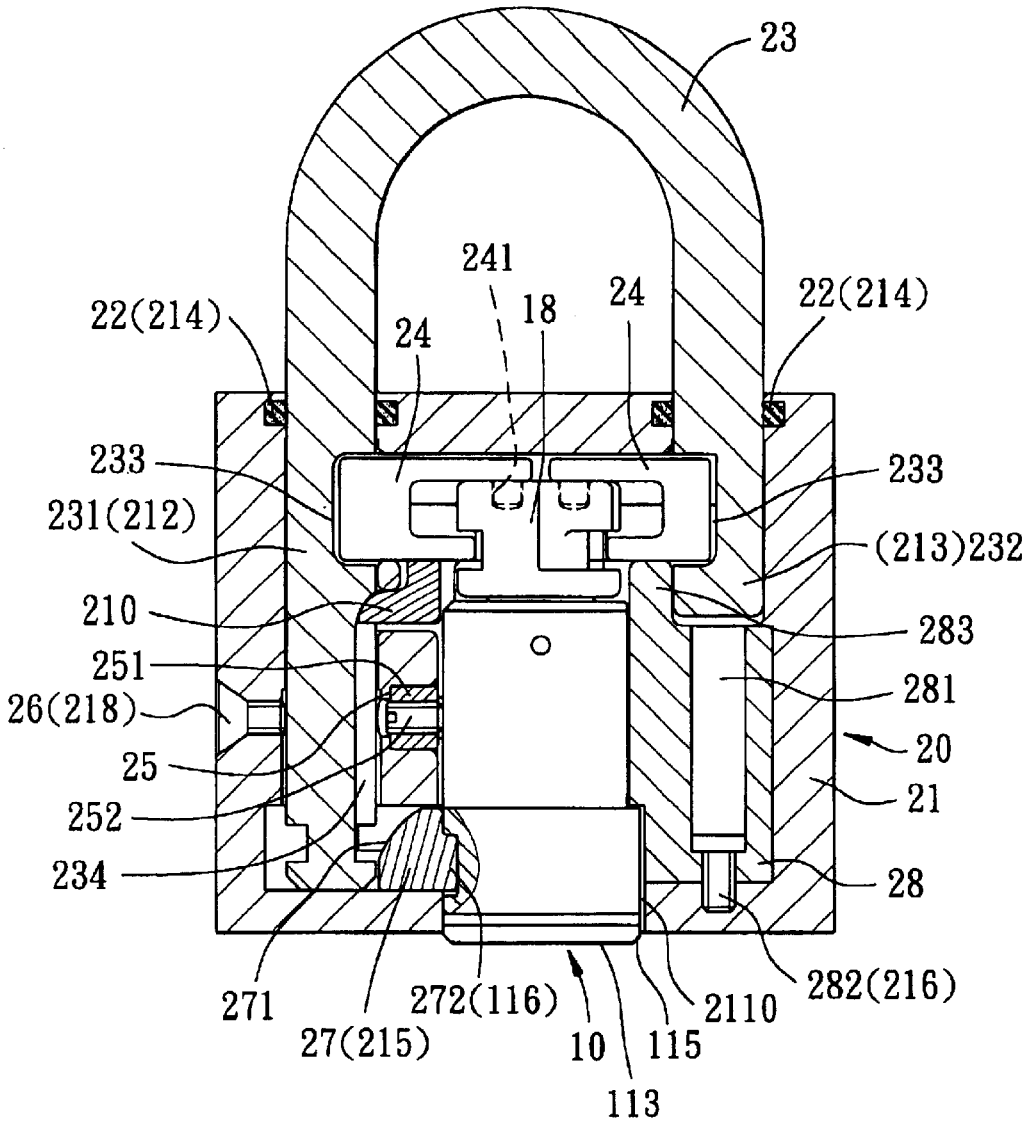
FIG. 5 is an assembled sectional view of the first preferred embodiment, illustrating a shackle member of the padlock body in a locked state.

Referring to FIGS. 3, 4 and 5, the padlock body 20 is shown to include a padlock housing 21, two seal rings 22, a shackle member 23, a latch unit in the form of two catch members 24, a securing member 25, a plug 26, a securing block 27, and a protective block 28.

The padlock housing 21 is substantially oval in cross section, is formed with a core chamber 211, and has a bottom portion formed with an opening 2110 for access into the core chamber 211. The lock core device 10 is received in the core chamber 211. The head end 111 of the lock shell 11 is capable of establishing watertight contact with the bottom portion of the padlock housing 21 through the seal member 118. The end face 113 of the lock shell 11 projects outwardly of the opening 2110 in the bottom portion of the padlock housing 21. The padlock housing 21 further has a top portion formed with left and right shackle holes 212, 213. Two annular grooves 214 are respectively formed in hole-defining walls that respectively define the shackle holes 212, 213 adjacent to open ends of the shackle holes 212, 213. The seal rings 22 are retained in the shackle holes 212, 213 in the respective one of the grooves 214. The interior of the padlock housing 21 is configured with a passage 215 that is disposed at an inner end of the left shackle hole 212 and that extends in a direction transverse to the left shackle hole 212 toward the core chamber 211. The padlock housing 21 is further formed with a threaded hole 216 at an inner end of the right shackle hole 213. The interior of the padlock housing 21 is further configured with a slide way 217 extending transverse to and extending between the left and right shackle holes 212, 213 and disposed above the core chamber 211. A shackle retainer 210 is mounted in the padlock housing 21 adjacent to the left shackle hole 212, and has a section extending into the left shackle hole 212.

Figure 8:
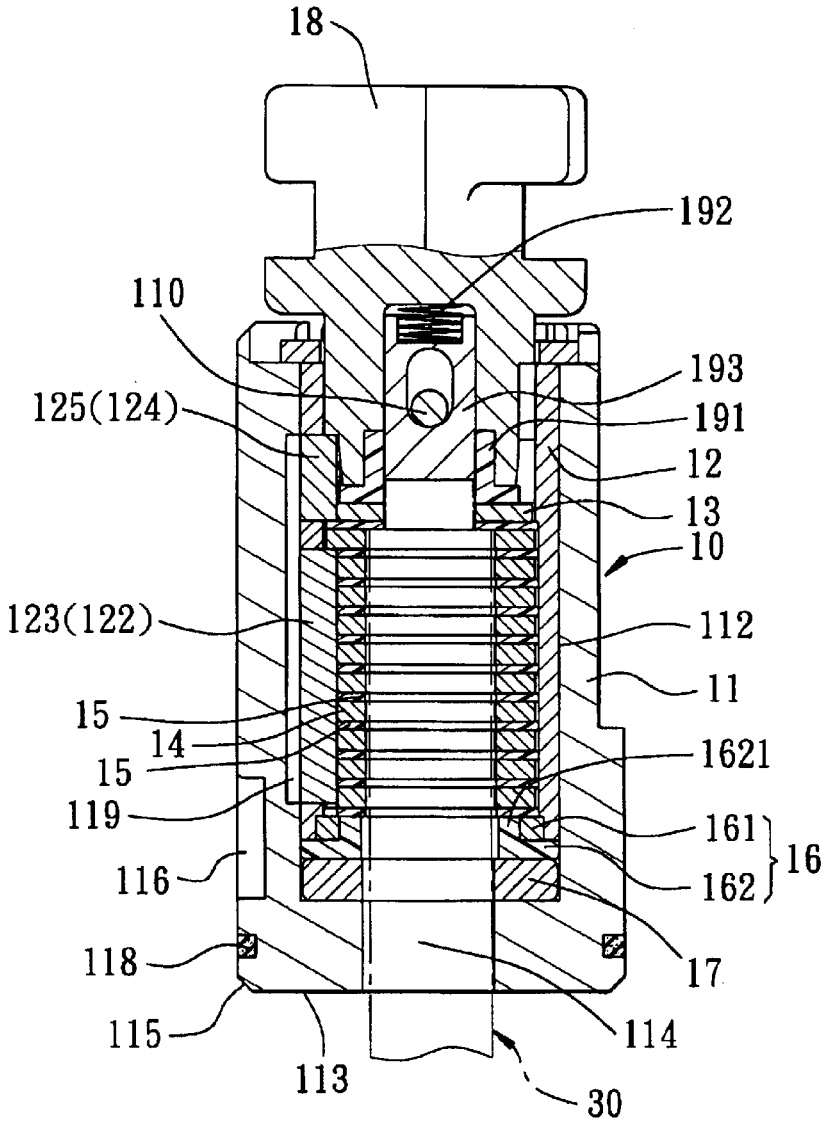
FIG. 8 is a fragmentary schematic sectional view of the lock core device of FIG. 1, illustrating how unlocking of the lock core device is made possible using a key that can drive rotation of the locking plates and the drive plate.

The shackle member 23 has a U-shaped configuration, and longer and shorter insert ends 231, 232. In this embodiment, the longer and shorter insert ends 231, 232 are respectively inserted into the shackle holes 212, 213 such that airtight contact is established between each of the longer and shorter insert ends 231, 232 and the padlock housing 21 through the seal rings 22 in the shackle holes 212, 213. Each of the longer and shorter insert ends 231, 232 is formed with a retaining groove 233 in an inner side thereof. The longer insert end 231 is further formed with a straight groove 234 and an annular groove 235. The shackle retainer 210 extends into the straight groove 234 and the annular groove 235 to prevent removal of the shackle member 23 from the padlock housing 21 in an unlocked state of the shackle member 23, as best shown in FIG. 8.

The catch members 24 are disposed in the slide way 217. Each of the catch members 24 has an axial pin 241 for coupling with the actuating portion 182 (see FIG. 1) of the latch actuator 18. When the correct key 30 is inserted into the lock core device 10 to rotate the latch actuator 18, the catch members 24 will be brought to engage or disengage the retaining grooves 233 in the longer and shorter insert ends 231, 232 of the shackle member 23, respectively.

The securing member 25 is disposed in the padlock housing 21 adjacent to the lock core device 10. The securing member 25 includes a nut 251 and a threaded rod 252. The nut 251 is embedded in the padlock housing 21 for threaded engagement with the threaded rod 252. The threaded rod 252 extends through the nut 251, and is capable of being tightened so as to abut against the lock core device 10 and retain the lock core device 10 in the core chamber 211. The padlock housing 21 is further formed with an aperture 218 that is aligned with the threaded rod 252. The aperture 218 normally receives the plug 26, which serves to close the aperture 218 to prevent entry of foreign objects into the padlock housing 21 through the aperture 218.

The securing block 27 is disposed in the passage 215. One side of the securing block 27, which is adjacent to the left shackle hole 212, is formed with a curved guiding surface 271. The longer insert end 231 of the shackle member 23 abuts against the guiding surface 271 to urge the securing block 27 to displace toward the lock core device 10, thereby tightening the securing block 27 against the lock core device 10 so as to retain the lock core device 10 in the core chamber 211. Another side of the securing block 27, which is adjacent to the core chamber 211, is formed with a protruding portion 272 for engaging the insert groove 116 in the lock shell 11 of the lock core body 10, as best shown in FIG. 5.

The protective block 28 is disposed in the right shackle hole 213 in the padlock housing 21, and has a height that complements the length of the shorter insert end 232 of the shackle member 23. The protective block 28 is formed with a fastener hole 281 registered with the right shackle hole 213 therethrough. A screw 282 is inserted through the fastener hole 281 to engage the threaded hole 216, thereby mounting removably the protective block 28 in the padlock housing 21. The protective block 28 has a top portion provided with a flange 283 to support the catch member 24 at the right side of the padlock housing 21. The protective block 28 is made of a hard metal alloy, and is disposed at a lateral side of the lock core device 10 so as to resist a drilling action coming from a lateral direction, thereby avoiding destruction of the lock core device 10 due to the drilling action.

The foregoing is a description of the major components of the weather-resistant lock apparatus according to this invention, and their relative structural relationships and positions. The locking and unlocking operations, as well as the intended effects, of this invention will be described in the succeeding paragraphs.

Referring to FIG. 5, in a locking state, the longer and shorter insert ends 231, 232 of the shackle member 23 are inserted in the shackle holes 212, 213 in the padlock housing 21, and are prevented from outward displacement by the catch members 24 of the latch unit. The lock core device 10 is retained in the padlock housing 21 by the securing member 25 that abuts theregainst. As the longer insert end 231 of the shackle member 23 shields the threaded rod 252 of the securing member 25, loosening of the threaded rod 252 is not permitted at this time such that removal of the lock core device 10 is not possible. In addition, as a lower edge of the longer insert end 231 of the shackle member 23 urges the securing block 27 to engage the insert groove 116 in the lateral side of the head end 111 of the lock shell 11, the lock core device 10 is firmly retained in the padlock housing 21 at this time.

Figure 6:
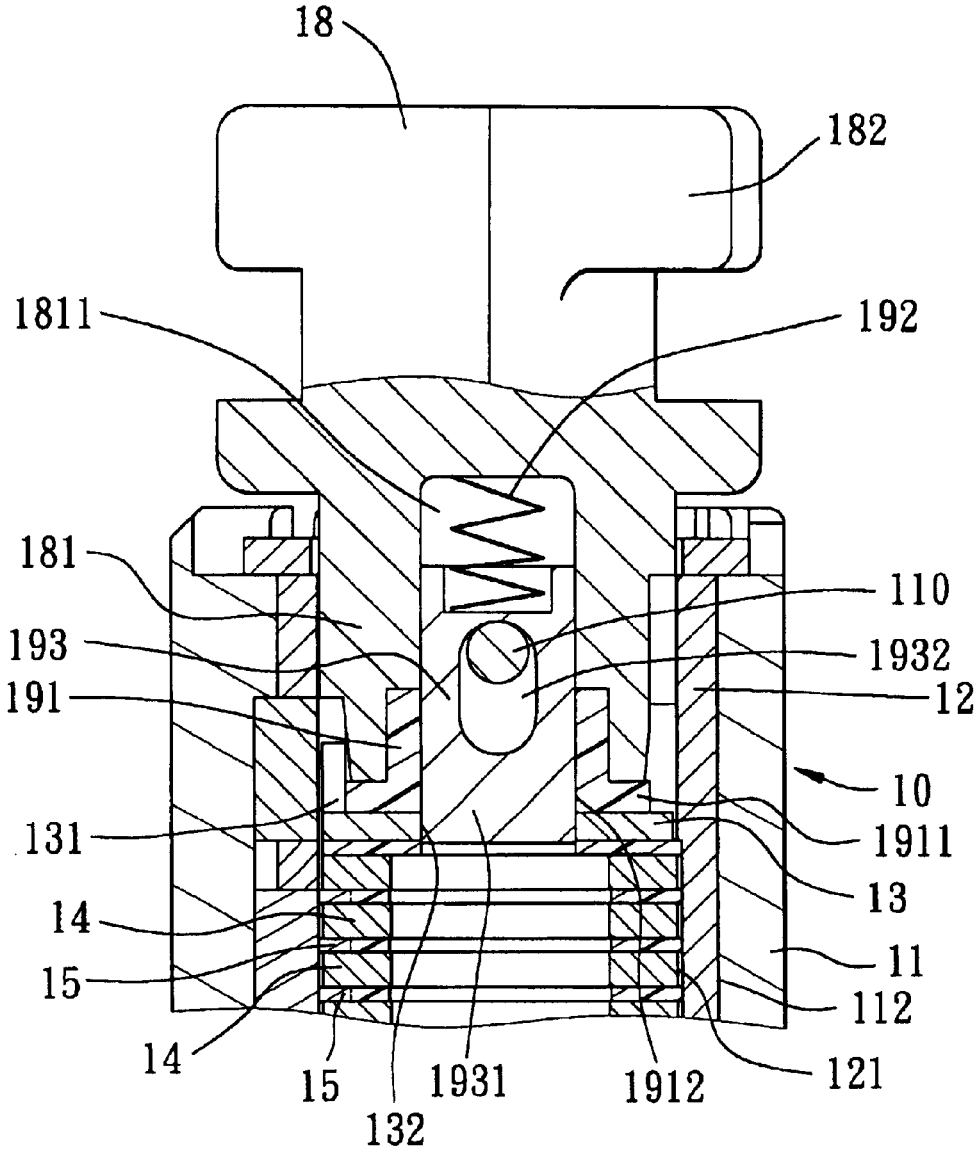
FIG. 6 is a fragmentary schematic sectional view of the lock core device of FIG. 1, illustrating how rotation of a drive plate can be prohibited by a rotation control member.

Referring to FIGS. 1 and 6, in the locking state, the drive plate 13 of the lock core device 10 is prevented from rotation by the control pin 193 of the rotation control member 19. The rotation control member 19 is provided mainly to maintain the drive plate 13 in a non-rotatable state. Therefore, even if the lock apparatus of this invention is subjected to strong external impact, the drive plate 13 will not be shaken out of place, and the locked state of the lock core device 10 can be maintained.

When it is desired to unlock the lock apparatus of this invention, the correct key 30 has to be inserted into the keyhole of the lock core device 10. Referring to FIGS. 1 and 8, the key bit portions 32 of the key 30 are used to bring the locking plates 14 to an unlocking state where the notches 141 in the locking plates 14 are aligned with one another so that the first control rod 123 can extend into the notches 141 in the locking plates 14 and disengage from the groove 119 in the lock shell 11. Moreover, the actuating tip portion 31 of the key 30 is inserted into the drive hole 132 in the drive plate 13 to push the control pin 193 against biasing action of the spring 192 to disengage from the drive plate 13 such that the drive plate 13 is rotatable with the key 30 to an unlocking state where the second control rod 125 is able to extend into the notch 133 in the drive plate 13 and thereby disengage from the groove 119 in the lock shell 11. At this time, the inner shell 12 will no longer be restricted by the first and second control rods 123, 125 and will be capable of rotation within the lock shell 11. When the drive plate 13 is rotated by the key 30, the drive projection 131 will engage the end wall 1911 of the sleeve member 191 to thereby transmit rotation of the drive plate 13 to the latch actuator 18.

Figure 7:
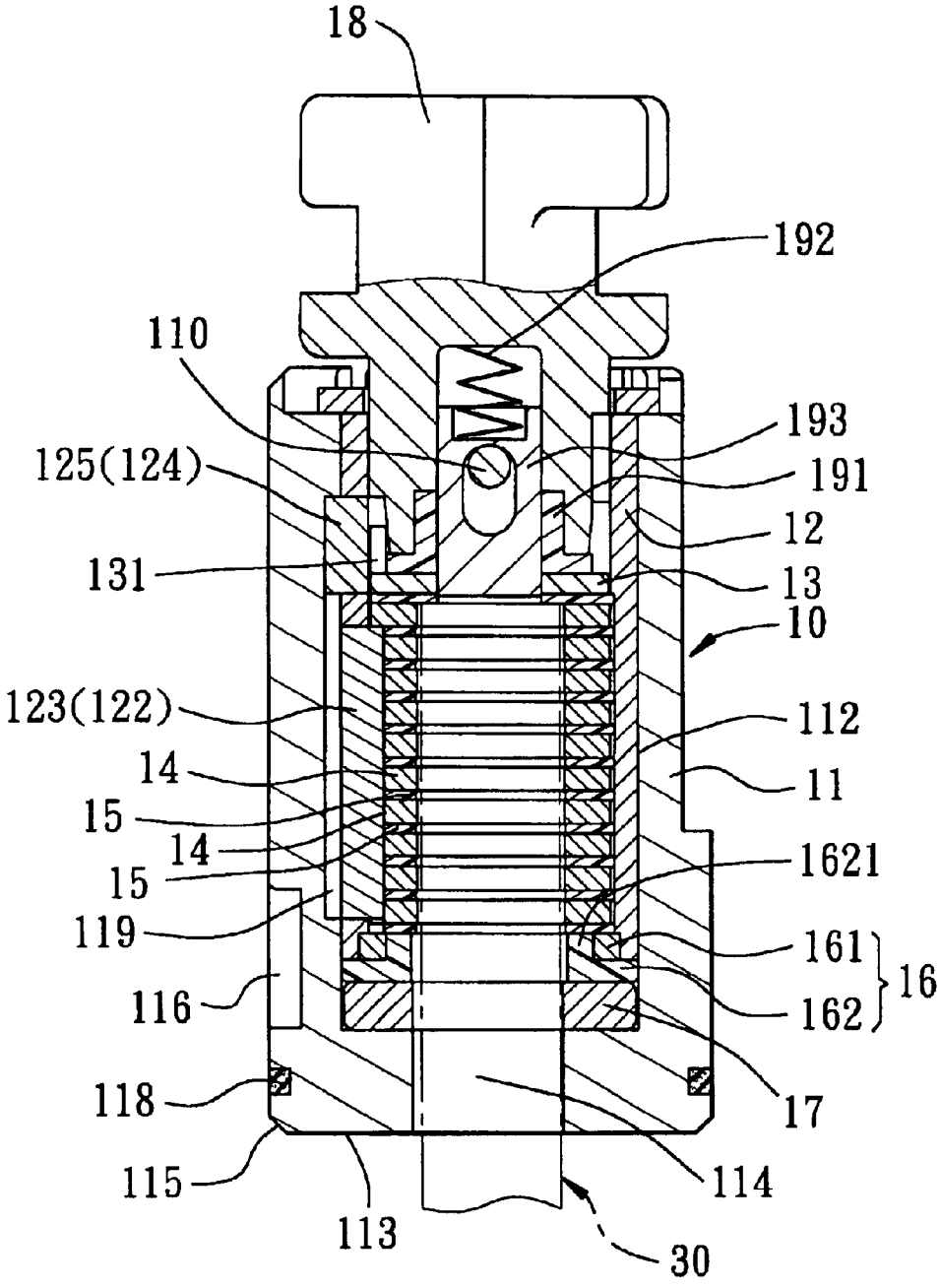
FIG. 7 is a fragmentary schematic sectional view of the lock core device of FIG. 1, illustrating how unlocking of the lock core device can be prohibited by the drive plate even when a key inserted therein can drive rotation of locking plates of the lock core device.

FIG. 7 illustrates a state where the key 30 is capable of driving the locking plates 14 to their unlocking states but is not provided with the correct actuating tip portion 31 (see FIG. 1) for driving rotation of the drive plate 13. It should be noted that the inner shell 12 at this time is prevented by the second control rod 125 from rotation within the lock shell 11. As it is necessary to dispose the two control rods 123, 125 in their unlocking positions in order to permit rotation of the latch actuator 18, the anti-theft effect of the lock apparatus of this invention is enhanced accordingly.

Figure 9:
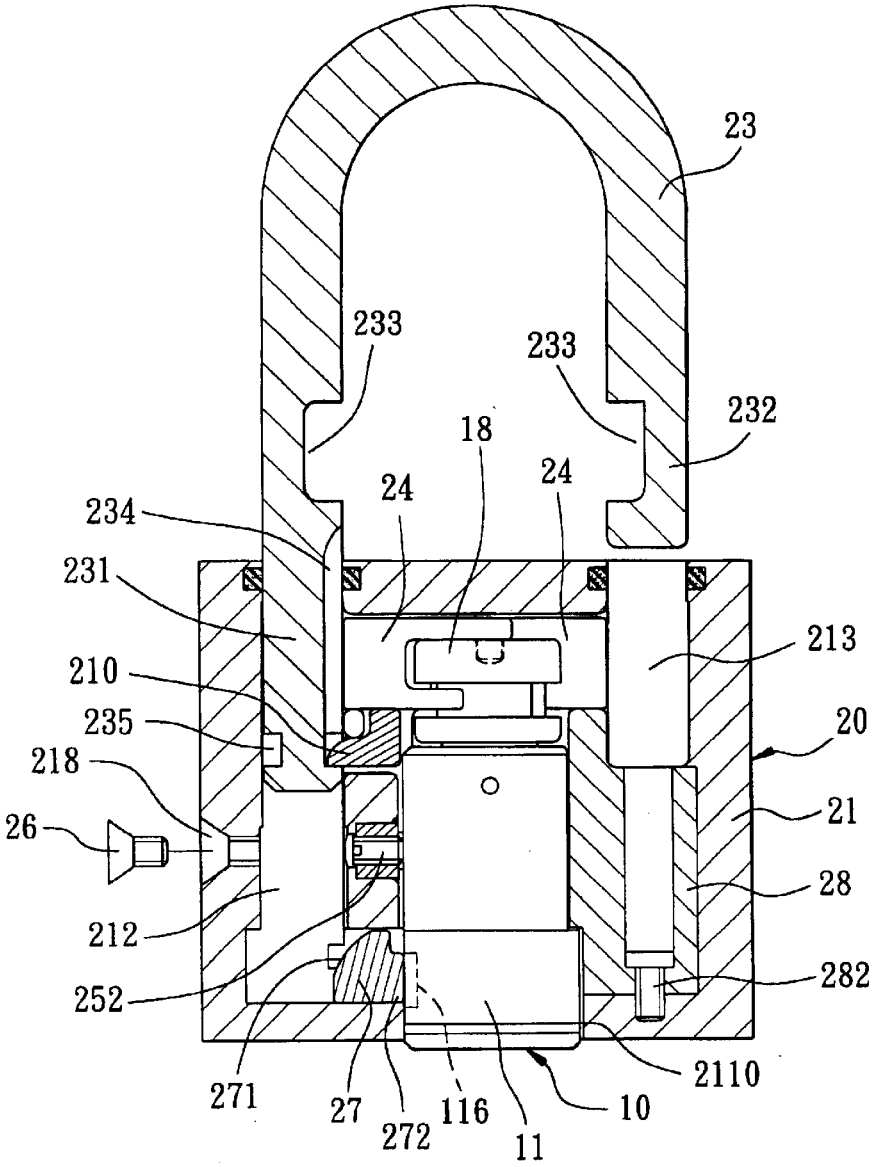
FIG. 9 is an assembled sectional view of the first preferred embodiment, illustrating the shackle member in an unlocked state.

Referring to FIG. 9, when the latch actuator 18 rotates as described hereinabove, due to the coupling between the actuating portion 182 (see FIG. 1) of the latch actuator 18 and the catch members 24, the catch members 24 are respectively disengaged from the retaining grooves 233 in the longer and shorter insert ends 231, 232 of the shackle member 23, thereby enabling the entire shackle member 23 to be pulled upwardly relative to the padlock housing 21. At this time, the longer insert end 231 of the shackle member 23 is blocked by the shackle retainer 210 from being uprooted completely from the left shackle hole 212, whereas the shorter insert end 232 can be removed completely from the right shackle hole 213. When the shackle member 23 is in an unlocked state, the longer insert end 231 no longer shields the threaded rod 252, and the securing block 27 is no longer urged by the longer insert end 231 toward the lock shell 11.

In the aforesaid unlocked state, the components of the lock apparatus of this invention can be dismantled in the following sequence:

First, the plug 26 is removed, and a tool (not shown) such as a hexagonal wrench, is extended into the aperture 218 to loosen the threaded rod 252. The lock core device 10 is then removed from the core chamber 211 through the opening 2110 in the bottom portion of the padlock housing 21.

After the lock core device 10 has been removed, a tool (not shown) is extended into the right shackle hole 213 to loosen the screw 282 in the protective block 28 and to remove the screw 282 from the threaded hole 216. The protective block 28 can be removed from the padlock housing 21 through the opening 2110 in the bottom portion of the padlock housing 21 at this time.

Thereafter, the catch members 24 can be removed from the padlock housing 21 through the opening 2110 in the bottom portion of the padlock housing 21.

Subsequently, the shackle retainer 210 and the securing block 27 are removed from the padlock housing 21, also through the opening 2110 in the bottom portion of the padlock housing 21.

Finally, the shackle member 23 is disassembled from the padlock housing 21.

As all of the internal components of the lock apparatus of this invention are detachable, defective or damaged components can be conveniently removed, and replacement components can be installed with relative ease by conducting the foregoing steps in a reverse order.

Figure 10:
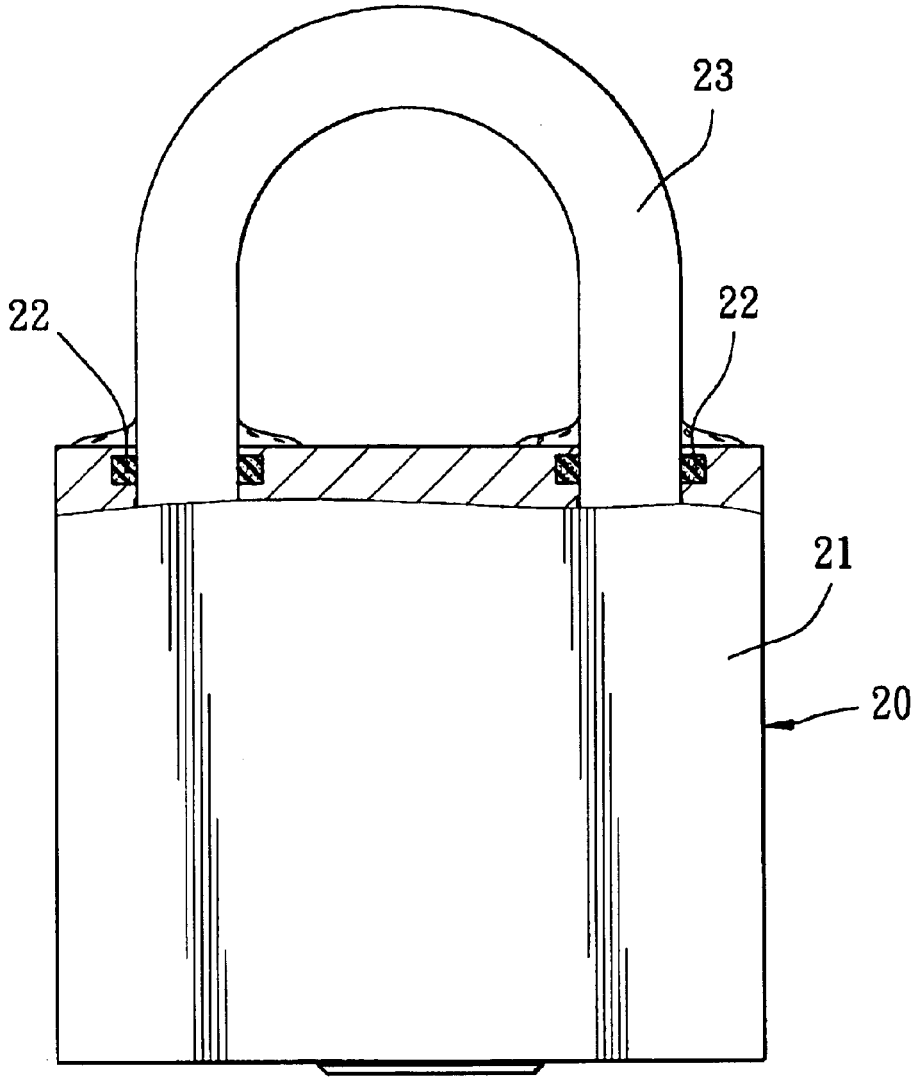
FIG. 10 is a partly sectioned, schematic view of the first preferred embodiment to illustrate airtight contact between the shackle member and two seal rings in the padlock housing of the padlock body.

Referring to FIG. 10, when the weather-resistant lock apparatus of this invention is used in a wet and humid environment, water may accumulate on the top portion of the padlock housing 21 at the open ends of the shackle holes. However, since the shackle holes are provided therein with the seal rings 22 to establish an airtight and watertight seal with the shackle member 23, water cannot enter into the padlock body 20 through the shackle holes, thereby avoiding rusting of components inside the padlock housing 21. Moreover, since water can be prevented from entering into the padlock body 20, the internal components are not likely to become frozen in cold climates so as not to affect normal operation of the lock apparatus of this invention.

Figure 11:
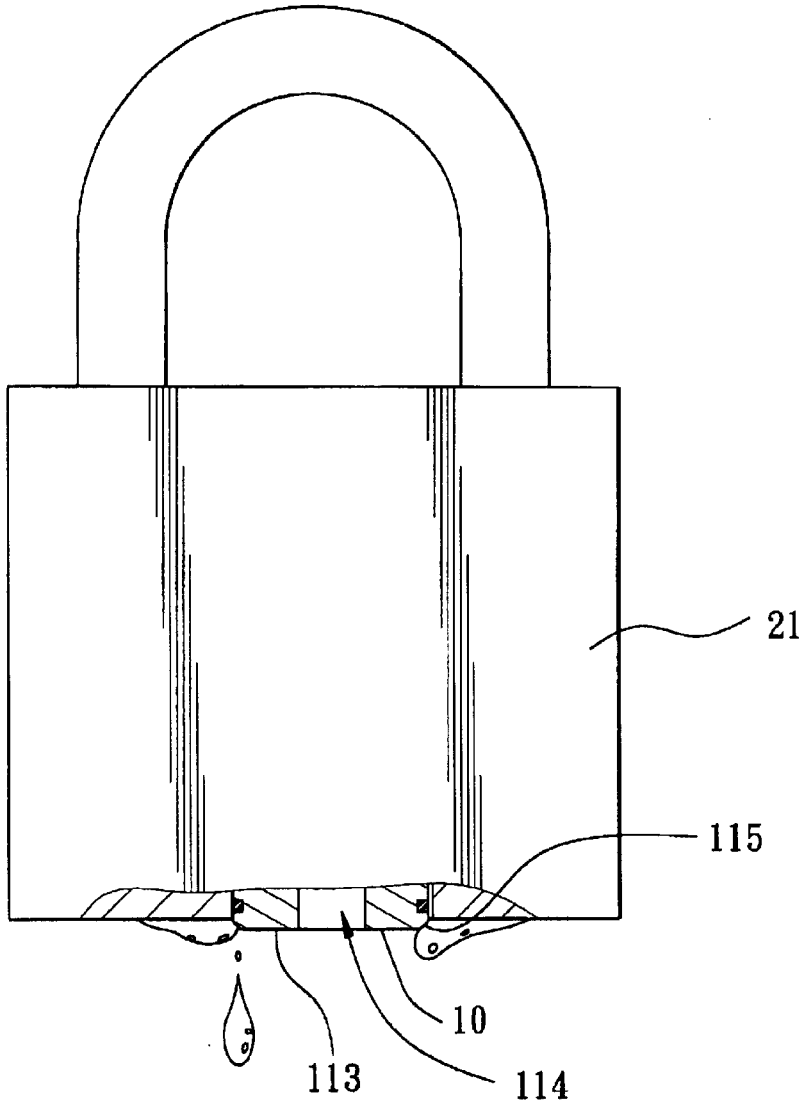
FIG. 11 is partly cutaway schematic view of the first preferred embodiment, illustrating how water can be prevented from seeping between the lock core device and the padlock housing.

Referring to FIG. 11, when the weather-resistant lock apparatus of this invention is exposed to a wet and humid environment, water may flow along the bottom portion of the padlock housing 21 and reach the lock core device 10. However, since the end face 113 of the lock shell 11 of the lock core device 10 projects outwardly of the padlock housing 21 and is provided with the beveled periphery 115, when the water reaches the beveled periphery 115, it will be stopped to accumulate thereat and eventually drop to the ground. Therefore, water can be prevented from entering through the key access hole 114 in the lock shell 11 and into the lock core device 10.

Figure 12:
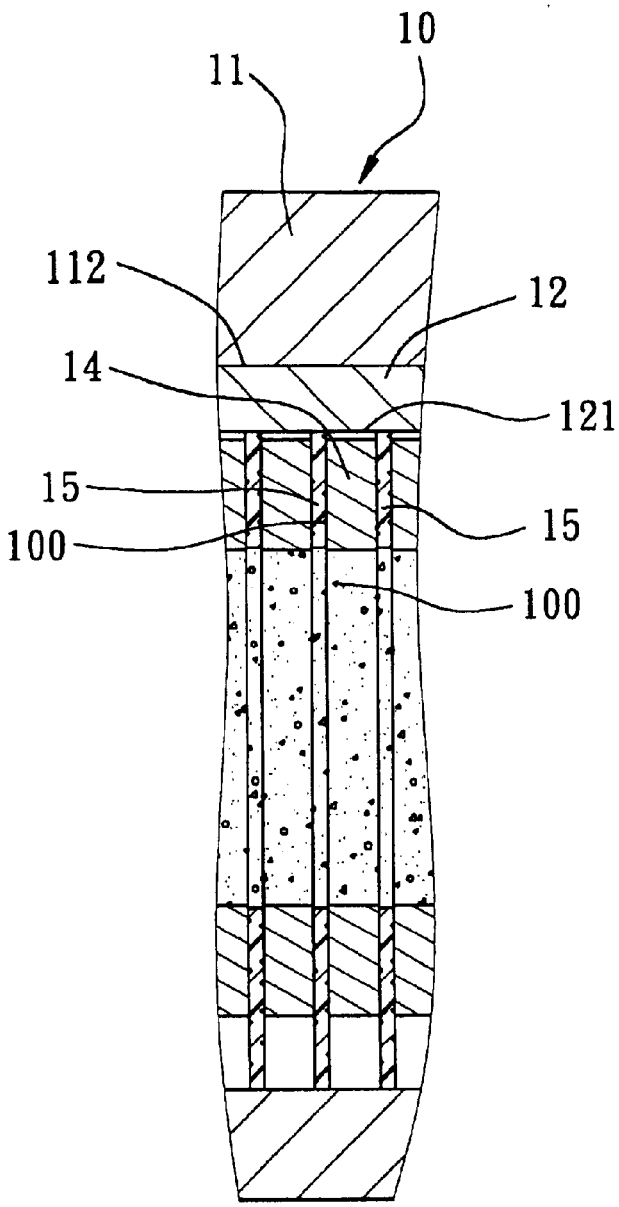
FIG. 12 is a fragmentary schematic sectional view of the lock core device of FIG. 1, illustrating how jamming of the locking plates can be prevented by spacer plates.

Referring to FIG. 12, when the weather-resistant lock apparatus of this invention is used in a windy and dusty environment, tiny sand grains 100 may enter the lock core device 10 through the key access hole 114. However, because the spacer plates 15 are made of tetrafluoroethylene polymer and are thus much softer than the locking plates 14 made of stainless steel, the sand grains 100 will be pressed into the surfaces of the spacer plates 15 when the locking plates 14 are rotated during operation, thereby preventing jamming of the locking plates 14 due to the presence of the sand grains 100. In other words, the locking plates 14 can rotate smoothly to permit normal functioning of the lock apparatus of this invention even in a windy and dusty environment. Similarly, as shown in FIG. 2, the drive plate 13 is disposed in contact with the tetrafluoroethylene polymer sleeve member 191, and the protective plate 17 is disposed in contact with the tetrafluoroethylene polymer protective sleeve 162 to render the internal components of the lock core device 10 resistant to sand and dust.

Figure 13:
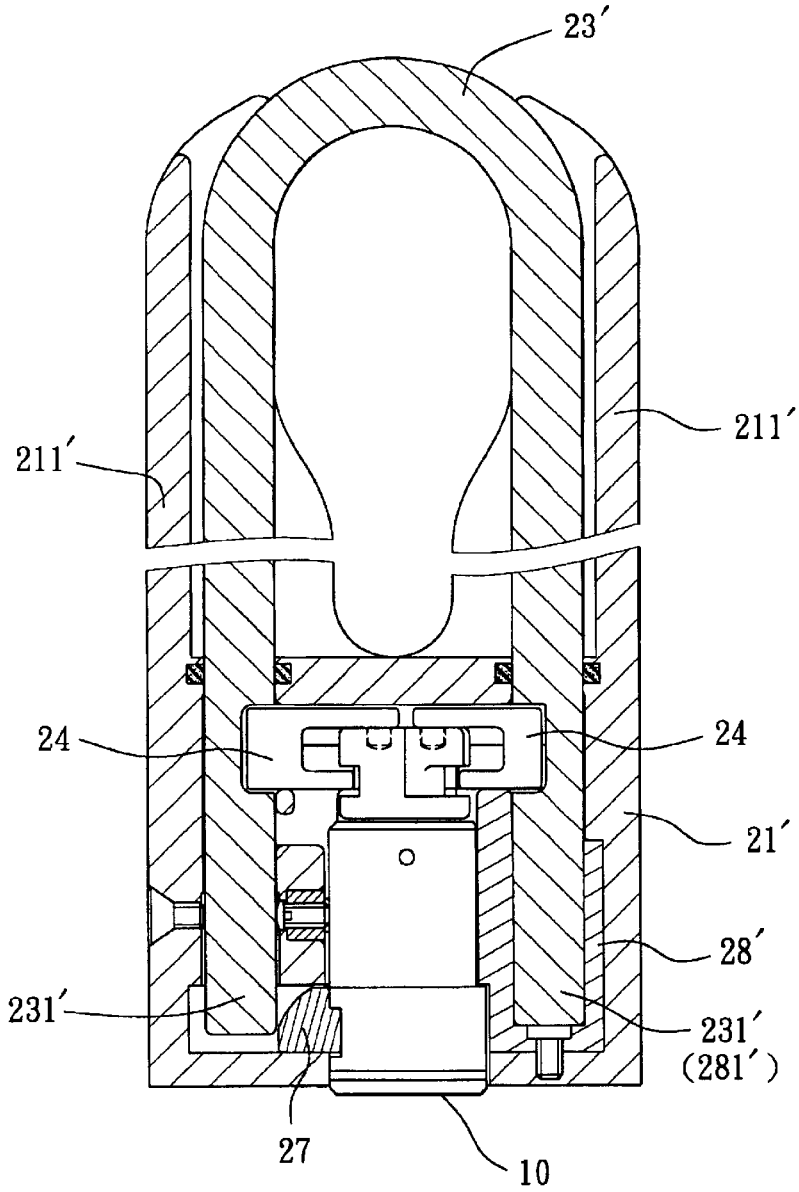
FIG. 13 is an assembled sectional view of another preferred embodiment of a weather-resistant lock apparatus according to this invention.

FIG. 13 illustrates the second preferred embodiment of the weather-resistant lock apparatus according to this invention, which is a modification of the previous embodiment. Like the previous embodiment, a padlock housing 21' has a lock core device 10, two catch members 24, and a securing block 27 mounted therein. The padlock housing 21' has two shackle guards 211' extending therefrom to protect a shackle member 23', and further accommodates a protective block 28' therein. The shackle member 23' has two insert ends 231' that are of equal length, and the fastener hole 281' in the protective block 28' is modified to receive one of the insert ends 231'. As the shackle retainer 210 (see FIG. 5) of the previous embodiment is not provided in the padlock housing 21', in an unlocked state, the shackle member 23' can be removed entirely from the padlock housing 21'.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A weather-resistant lock apparatus comprising a lock core device that includes a lock shell and a lock core unit, said lock core unit including an inner shell received in and rotatable relative to said lock shell, a plurality of locking plates received in and rotatable relative to said inner shell, said locking plates cooperating to form a keyhole of said lock core unit, a first locking unit operably associated with said locking plates for locking said inner shell against rotation relative to said lock shell in a locking state of said locking plates, and for unlocking said inner shell for rotation relative to said lock shell in an unlocking state of said locking plates, a latch actuator coupled to said inner shell, and a plurality of spacer plates, each of which is disposed between an adjacent pair of said locking plates, wherein said spacer plates are made of a material with a hardness less than that of said locking plates.

2. The weather-resistant lock apparatus as claimed in claim 1, wherein said lock core unit further includes a drive plate received in and rotatable relative to said inner shell, said drive plate being disposed between said locking plates and said latch actuator and cooperating with said locking plates to form said keyhole, said drive plate being capable of transmitting a rotary force applied through a correct key that was inserted into said keyhole to said latch actuator.

3. The weather-resistant lock apparatus as claimed in claim 2, wherein said drive plate is formed with a non-circular drive hole that forms a part of said keyhole, said lock core unit further including a rotation control member mounted on said latch actuator and registered with said drive hole, said rotation control member extending into and engaging said drive plate in said drive hole to prohibit rotation of said drive plate, and being movable to disengage from said drive plate when the correct key is inserted into said keyhole so as to permit rotation of said drive plate with the correct key in order to drive rotation of said latch actuator.

4. The weather-resistant lock apparatus as claimed in claim 3, wherein said latch actuator has a coupling portion connected to said inner shell, said coupling portion being formed with a cavity for receiving said rotation control member therein, said latch actuator further having a sleeve member mounted fittingly in said cavity, said sleeve member having a fan-shaped end wall, said rotation control member extending through said end wall, said drive plate being formed with a drive projection for engaging said end wall of said sleeve member so as to transmit rotation of said drive plate to said latch actuator.

5. The weather-resistant lock apparatus as claimed in claim 4, wherein said rotation control member includes a control pin that extends through said end wall for engaging said drive plate in said drive hole, and a spring for biasing said control pin to extend into said drive hole.

6. The weather-resistant lock apparatus as claimed in claim 5, wherein said control pin is formed with an axially extending slot therealong, said inner shell being provided with a retaining pin that extends through said coupling portion of said latch actuator and through said slot in said control pin, thereby limiting axial movement of said control pin.

7. The weather-resistant lock apparatus as claimed in claim 2, wherein said lock core unit further includes a second locking unit operably associated with said drive plate for locking said inner shell against rotation relative to said lock shell in a locking state of said drive plate, and for unlocking said inner shell for rotation relative to said lock shell in an unlocking state of said drive plate.

8. The weather-resistant lock apparatus as claimed in claim 1, wherein said spacer plates are made of tetrafluoroethylene polymer.

9. The weather-resistant lock apparatus as claimed in claim 1, further comprising a padlock body that includes:

a padlock housing formed with a core chamber, and having a bottom portion formed with an opening for access into said core chamber, said lock core device being received in said core chamber, said padlock housing further having a top portion formed with two shackle holes; and a shackle member having two insert ends that are inserted into said shackle holes, respectively.

10. The weather-resistant lock apparatus as claimed in claim 9, wherein said padlock body further includes a latch unit disposed in said padlock housing and coupled to said latch actuator for engaging at least one of said insert ends of said shackle member.

11. The weather-resistant lock apparatus as claimed in claim 9, wherein said padlock body further includes two seal rings, each of which is retained in a respective one of said shackle holes for establishing airtight contact with a respective one of said insert ends of said shackle member.

12. The weather-resistant lock apparatus as claimed in claim 9, wherein said lock shell has an end face accessible at said opening in said bottom portion of said padlock housing and formed with a key access hole registered with said keyhole.

13. The weather-resistant lock apparatus as claimed in claim 12, wherein said end face of said lock shell projects outwardly of said opening in said bottom portion of said padlock housing, and is formed with a beveled periphery.

14. The weather-resistant lock apparatus as claimed in claim 12, wherein said lock shell has a peripheral surface fitted with a seal member for establishing watertight contact with said bottom portion of said padlock housing at said opening.

15. The weather-resistant lock apparatus as claimed in claim 12, wherein said lock core unit further includes a sealing member adjacent to said key access hole, said sealing member including a sealing ring fitted in said inner shell, and a protective sleeve made of tetrafluoroethylene polymer, said protective sleeve being fitted in said lock shell and being formed with an annular skirt that extends into and that is in sleeved engagement with said sealing ring.

16. The weather-resistant lock apparatus as claimed in claim 9, wherein said lock core device is removable from said core chamber through said opening in said bottom portion of said padlock housing, said padlock body further including a securing member disposed in said padlock housing, said securing member including a threaded rod mounted threadedly in said padlock housing and capable of being tightened so as to abut against said lock core device and retain said lock core device in said core chamber, said threaded rod being capable of being loosened to permit removal of said lock core device from said core chamber through said opening in said bottom portion of said padlock housing.

17. The weather-resistant lock apparatus as claimed in claim 16, wherein said padlock housing is formed with an aperture that is aligned with said threaded rod, said padlock body further including a plug for closing said aperture.

18. The weather-resistant lock apparatus as claimed in claim 9, wherein said lock core device is removable from said core chamber through said opening in said bottom portion of said padlock housing, said padlock body further including a securing block disposed in said padlock housing at an inner end of one of said shackle holes and movable toward and away from said core chamber in a direction transverse to said one of said shackle holes, said securing block having a curved guiding surface, one of said insert ends of said shackle member abutting against said curved guiding surface to tighten said securing block against said lock core device so as to retain said lock core device in said core chamber.

19. The weather-resistant lock apparatus as claimed in claim 18, wherein said lock shell is formed with an insert groove, and said securing block has a protruding portion for engaging said insert groove.

20. The weather-resistant lock apparatus as claimed in claim 9, wherein said lock core device is removable from said core chamber through said opening in said bottom portion of said padlock housing, said padlock body further including a protective block disposed in one of said shackle holes and abutting against said lock core device, said protective block being removable through said opening in said bottom portion of said padlock housing after removal of said lock core device from said core chamber.

21. The weather-resistant lock apparatus as claimed in claim 20, wherein said protective block is formed with a fastener hole registered with said one of said shackle holes, said padlock housing being formed with a threaded hole registered with said fastener hole, said padlock body further including a screw inserted through said fastener hole and threadedly engaging said threaded hole so as to mount removably said protective block in said padlock housing.

22. The weather-resistant lock apparatus as claimed in claim 21, wherein said fastener hole in said protective block has a size sufficient to receive one of said insert ends of said shackle member.

23. The weather-resistant lock apparatus as claimed in claim 9, wherein said lock core device is removable from said core chamber through said opening in said bottom portion of said padlock housing, said padlock body further including a shackle retainer mounted in said padlock housing adjacent to one of said shackle holes, said shackle retainer engaging one of said insert ends of said shackle member to prevent removal of said shackle member from said padlock housing, said shackle retainer being removable from said padlock housing through said opening in said bottom portion of said padlock housing to permit removal of said shackle member from said padlock housing after removal of said lock core device from said core chamber.

* * * * *